United States Patent [19]

Bettger et al.

[11] 4,023,317

[45] May 17, 1977

[54] BUILDING UNIT

[76] Inventors: Lloyd Erwin Bettger, 1335 Cunningham Road; Charles Albert Jensen, 740 Sparrow Road, both of Kelowna, British Columbia, Canada

[22] Filed: Oct. 14, 1975

[21] Appl. No.: 622,058

[52] U.S. Cl. ..... 52/204; 52/80; 52/262; 52/395; 52/403; 52/463

[51] Int. Cl.[2] ..... E04D 1/36; E06B 1/04

[58] Field of Search ..... 52/80, 81, 90, 602, 52/72, 463, 300, 303, 461, 262, 204, 395, 403

[56] References Cited

UNITED STATES PATENTS

| | | | |
|---|---|---|---|
| 1,592,070 | 7/1926 | Blake | 52/602 |
| 1,723,307 | 8/1929 | Sipe | 52/465 |
| 1,931,750 | 10/1933 | Blaski | 52/72 |
| 2,602,323 | 7/1952 | Leemhuis | 52/303 |
| 2,742,115 | 4/1956 | Strong | 52/465 |
| 2,871,521 | 2/1959 | Messmore | 52/80 |
| 2,944,370 | 7/1960 | Malarkey | 52/81 |
| 3,289,370 | 12/1966 | Van Etten | 52/90 |
| 3,688,460 | 9/1972 | Loghem et al. | 52/466 |
| 3,763,608 | 10/1973 | Chamlee | 52/80 |
| 3,793,789 | 2/1974 | Greenamyer | 52/463 |
| 3,808,761 | 5/1974 | Green et al. | 52/300 |

*Primary Examiner*—Price C. Faw, Jr.
*Assistant Examiner*—James L. Ridgill, Jr.
*Attorney, Agent, or Firm*—Larson, Taylor and Hinds

[57] ABSTRACT

A building unit. The unit comprises a panel with a flange extending substantially normally from each of at least two opposing sides. Attachment means are formed in the flanges so that one panel can be attached to a panel formed with similar flanges to construct a strong, easily erected building that can be of large area and easily insulated.

6 Claims, 20 Drawing Figures

Fig. 9.
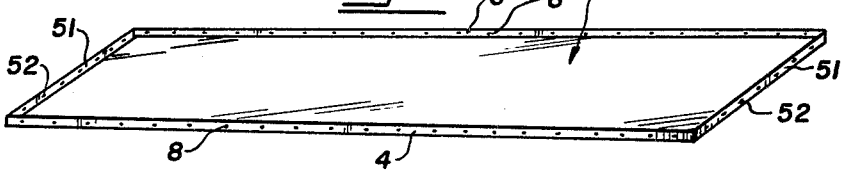
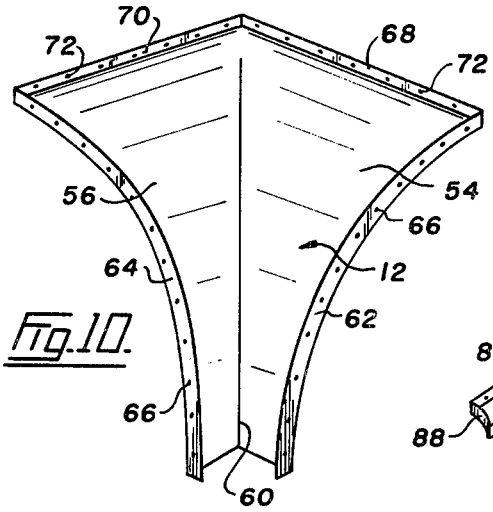
Fig. 10.
Fig. 11.
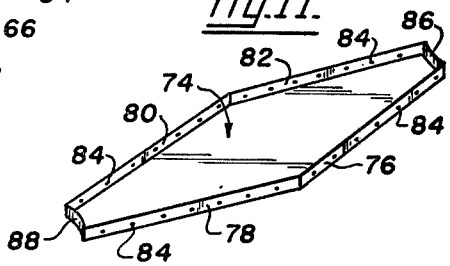
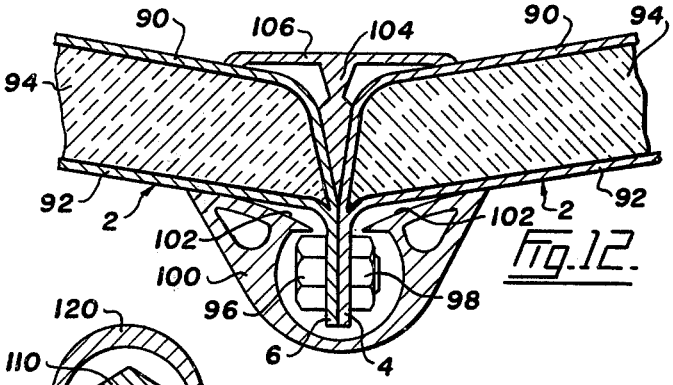
Fig. 12.
Fig. 13.
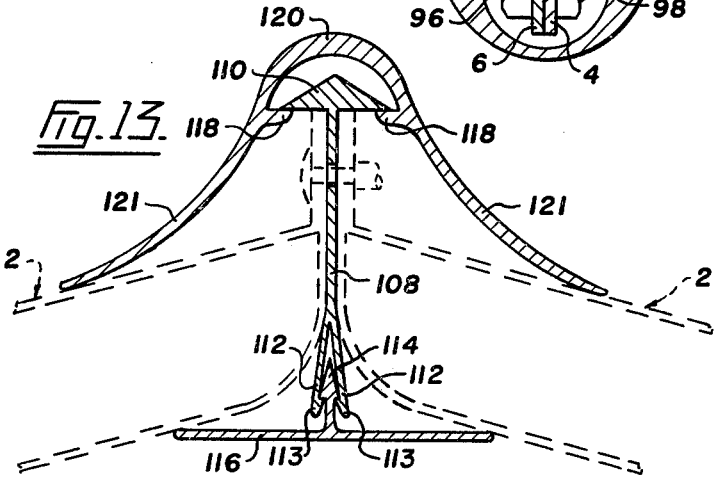

Fig. 17.
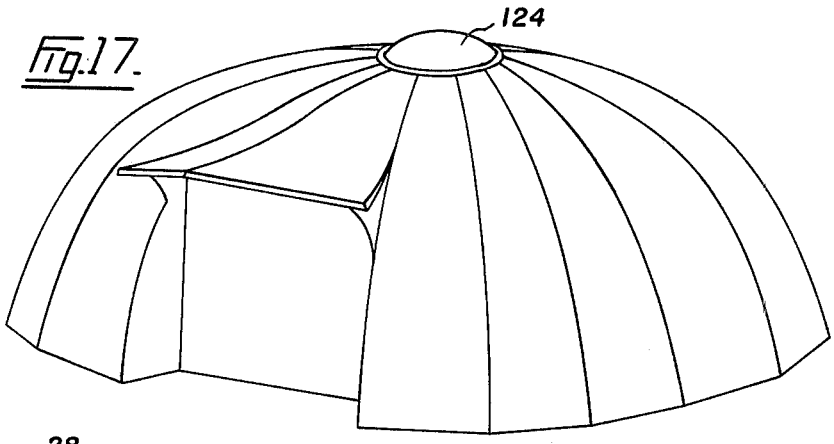
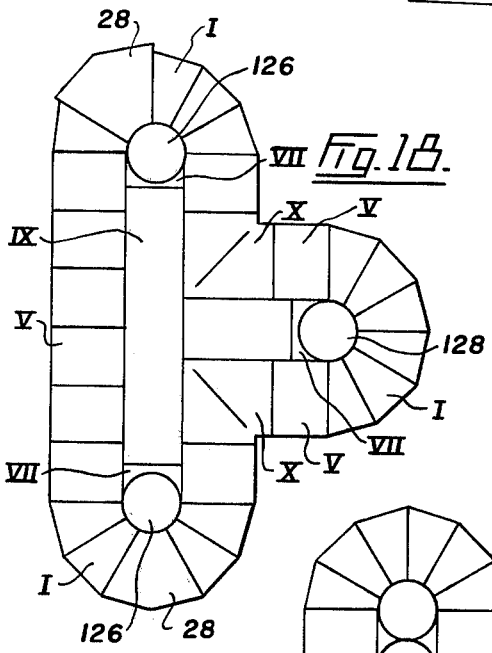
Fig. 18.
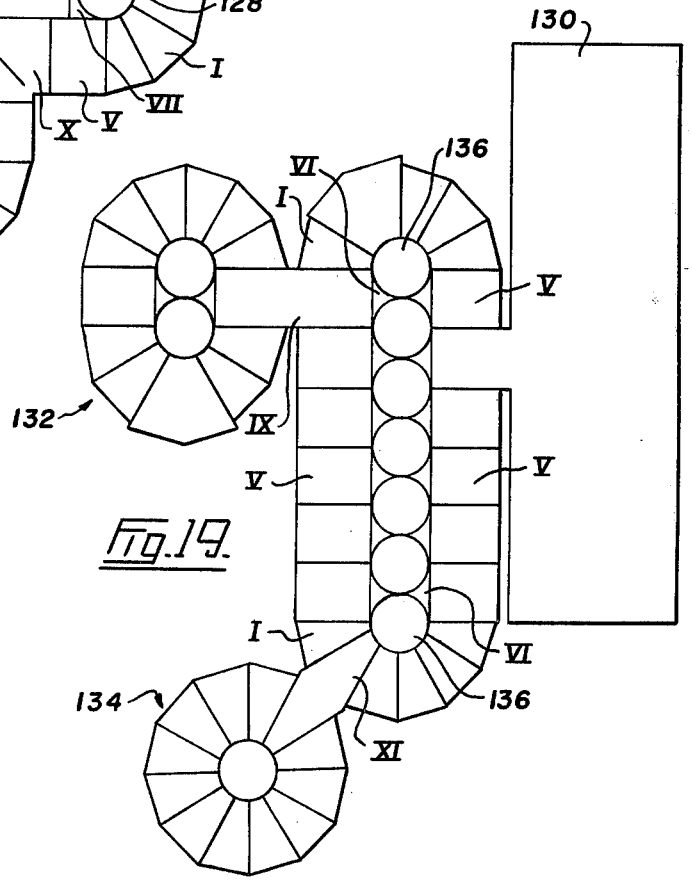
Fig. 19.

BUILDING UNIT

FIELD OF THE INVENTION

This invention relates to a building unit, a building formed from a plurality of the building units and a method of constructing the building.

DESCRIPTION OF THE PRIOR ART

There is a considerable demand for buildings that are cheap, easy to construct and, in many cases, purely temporary. Such buildings are required for living accommodation and for storage. They find particular use in extremely cold parts of the world, for example in the Arctic during exploration for oil or minerals. These buildings should be easily constructed and dismantled, easily transported and adequately insulated against the extremes of cold found in the Arctic.

There are a number of existing buildings of this type. However, they suffer from a number of disadvantages. Many of the buildings require the bending on the site of preformed, flat building panels. The stress in the panel resulting from the bending, is an essential part of the building. However, the bending also introduces a number of disadvantages. First, it restricts the size of the building. So far the largest building made using the above technique has been about 25 feet in diameter. Clearly, the panels can only be of limited thickness if they are to be curved on the building site and, equally clearly, it is difficult to apply adequate insulation, for example, for Arctic conditions. If a thick foam insulation is applied to a panel then there is a strong possibility that the insulation will crack on bending or will form creases that reduce its efficiency.

Many of these prior buildings must have sealing strips between adjacent panels. This is undesirable because in very cold weather the strips can split when being hammered into place.

Early proposals have also involved the bowing and securing together of previously stressed panels. The result is a dome-like structure in which the panels are secured together by overlapping them and bolting them together or by bolting bands to a pair of adjoining panels. In another prior art suggestion, panels are joined by clips. A cable is run through the uppermost clips of each panel to retain the upper ends of the stressed panels in the required position.

SUMMARY OF THE INVENTION

The present invention seeks to avoid the disadvantages of the above buildings by providing, in its broadest aspect, a building unit that is pre-curved and thus does not need to be curved at the building site. Furthermore, the means of joining adjacent panels is built into each panel. The sealing of the building is simple to carry out and the sealing units are not important structural elements in the building. Furthermore, the invention is such that a wide variety of shapes of buildings can be built. There is no restriction on the size of the building resulting from its mode of construction.

Thus, in a first aspect, the present invention is a building unit comprising a panel, a flange extending substantially normally from each of at least two opposing edges of the panel and attachment means formed in the flanges whereby one panel can be attached to a panel formed with similar flanges. In a preferred embodiment, all four edges of the panel are formed with flanges.

In another aspect, the present invention is a building formed from a plurality of the above building units attached to each other.

In yet another aspect, the invention is a method of constructing a building made up of the above building units. The method comprises locating a first unit in a raised position approximating to the position required of the building, placing a second unit equipped with a similar flange adjacent the first unit, afixing the attachment means to secure the units together, positioning a third unit provided with a corresponding flange adjacent the free flange of either the first or second unit and attaching the third unit in the appropriate position by the attachment means. The process is continued until the building is complete.

The incorporation of door-ways, skylights and windows is a simple matter. In the case of windows it is desirable that certain of the panels be formed with openings with a window sealed into the opening in the manner of, for example, an automobile window in which gaskets are used.

BRIEF DESCRIPTION OF THE DRAWINGS

Aspects of the invention are illustrated, by way of example, in the accompanying drawings in which:

FIGS. 1 to 11 illustrate various building units according to the present invention;

FIGS. 12 and 13 indicate methods of sealing and finishing the joints between adjacent building units in a building according to a further aspect of the present invention;

FIGS. 14 to 17 illustrate the steps in the construction of a simple building according to the present invention;

FIGS. 18 and 19 exemplify the wide variety of shapes available in buildings according to the present invention.

DESCRIPTION OF PREFERRED EMBODIMENTS

Figure 1:
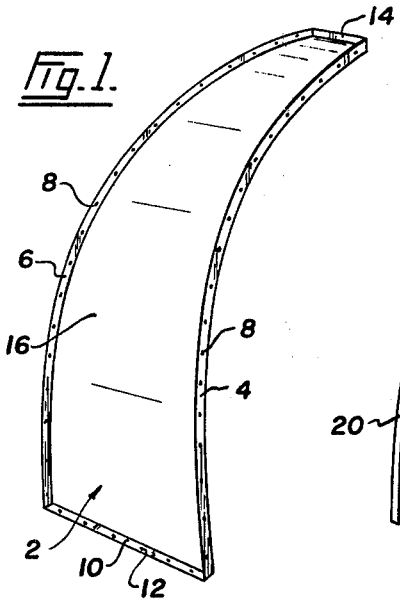

FIG. 1 illustrates a building unit comprising a panel 2 with flanges 4 and 6 extending from opposite edges of the panels. Each flange 4 and 6 is formed with holes 8 that provide an attachment means whereby one panel can be attached to a panel formed with similar flanges 4 and 6. In addition the unit of FIG. 1 is provided with a bottom flange 10 formed with holes 12. The panel in FIG. 1 is also formed with an upper flange 14.

Panel 2 is of a shape that would be obtained by locating one of the parallel sides of a curvilinear trapezoidal panel and applying a bending force evenly across the other, free parallel side to form a panel having a concave and a convex surface. The flanges 4, 6, 10 and 14 of the building unit 2 extend outwardly from the convex or outer surface 16 of the panels 2.

FIS. 2 to 4 illustrate parts, not necessarily according to the present invention, that can be used in conjunction with the building units of FIG. 1 to produce the majority of the structure of a simple building according to the present invention. The description of such a building will be set out later in describing FIGS. 14 to 17.

Figure 2:
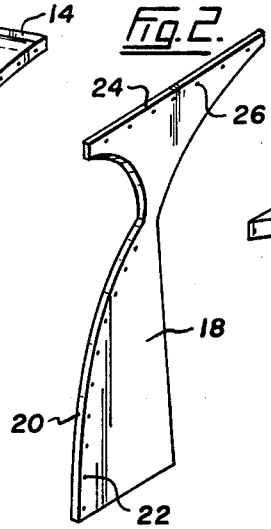

FIG. 2 shows a door adaptor piece 18 having a curved edge 20 provided with holes 22 and an upper edge 24 provided with holes 26.

Figure 3:
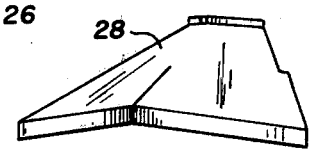

FIG. 3 illustrates a roof piece 28 provided with downwardly projecting flanges (not shown) provided with holes (not shown) to align with the holes 26 in the upper edge 24 of the door adaptor piece 18.

Figure 4:
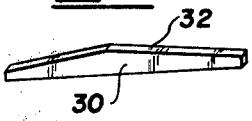

FIG. 4 illustrates a stress beam 30 to be fitted over a door frame so that its upper surface 32 may support a roof piece 28. The upper surface 32 is shaped to correspond with the shape of the roof piece 28.

Figure 5:
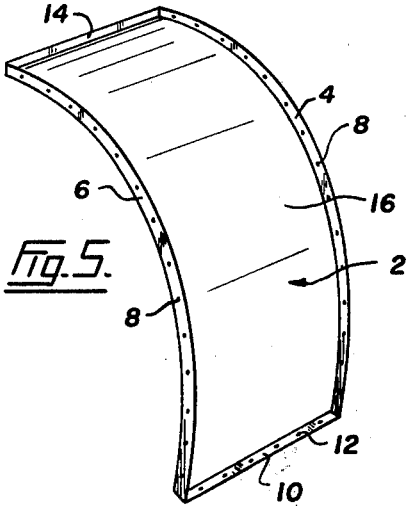

FIG. 5 illustrates a building unit similar to the building unit shown in FIG. 1. Like the unit of FIG. 1 it comprises a panel 2 having flanges 4 and 6 with holes 8 formed in the flanges 4 and 6. The panel is formed with a bottom flange 10 having holes 12. An upper flange 14 is also present. However, the unit of FIG. 5 differs from that of FIG. 1 in its configuration. FIG. 5 is a building unit in which the panel is of a shape that would be obtained by locating one edge of a flat, rectangular panel and curving the panel by applying a bending force evenly across the free edge remote from the located edge to form a panel having a concave and convex surface. Like the building unit of FIG. 1, the building unit of FIG. 5 has a convex outer surface 16 and the flanges 4, 6, 10 and 14 extend outwardly from the convex surface 16.

Figure 8:
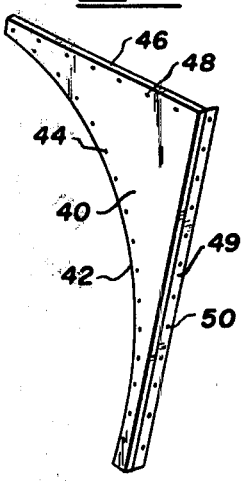

FIGS. 6 to 11 illustrate building units, all except FIG. 8 being according to the present invention, that can be used in conjunction with the building units shown in FIGS. 1 to 4 to produce the complex structures shown in FIGS. 18 and 19.

Figure 6:
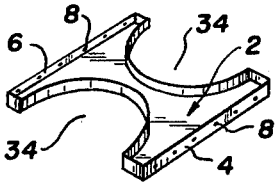

FIG. 6 illustrate a building unit comprising a panel 2 having flanges 4 and 6 formed with holes 8. Thus the building unit of FIG. 6 is, like the panel of FIG. 1, a building unit according to the present invention. The building unit of FIG. 6, however, has semi-circular inserts 34 formed on opposed sides.

Figure 7:
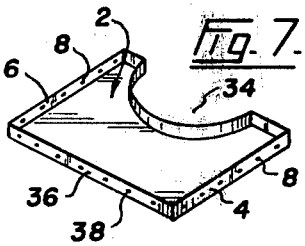

The building unit of FIG. 7 reseambles that of FIG. 6 except that it has one semi-circular insert 34. On the edge opposite from the semi-circular insert 34 the building unit of FIG. 7 has a flange 36 formed with holes 38.

FIG. 8 shows an adaptor piece 40 having a curved edge 42 formed with holes 44 a straight edge 46 formed with holes 48 and a flange 49 formed with holes 50. The use of adaptor piece 40 will be described later in conjunction with FIG. 19.

FIG. 9 illustrates a building unit resembling the building unit of FIGS. 1 and 5 and comprising a panel 2 formed with flanges 4 and 6. Flanges 4 and 6 are formed with holes 8. The building unit of FIG. 9 has end flanges 51 formed with holes 52. Unlike the building units of FIGS. 1 and 5, the panel 2 of the building unit of FIG. 5 is a flat rectangle.

FIG. 10 illustrates a building unit according to the invention that is useful in forming buildings according to the invention provided with extensions or wings. The unit of FIG. 10 permits extensions or wings at right angles to a main body. Its use will be described later in conjunction with the description of FIG. 18. Unlike the building units of FIGS. 1, 5 and 9, the building unit of FIG. 10 has a panel 12 made up of two curved portions 54 and 56 joined at 60. The curved portions 54 and 56 are at right angles to each other. The building unit of FIG. 10 has flanges 62 and 64 formed on opposing sides. Flanges 62 and 64 are provided with holes 66. In addition, each curved part 54 and 56 is formed with an upper flange 68 and 70 respectively. Holes 72 are positioned in the upper flanges 68 and 70.

FIG. 11 illustrates a building unit whose use will be described with regard to FIG. 19. The building unit of FIG. 11 resembles that of FIG. 9 except that the unit of FIG. 11 is an elongated hexagon. The building unit of FIG. 11 comprises a panel 74 of generally hexagonal shape. The panel is provided with flanges 76, 78, 80 and 82 at its longer sides. All these flanges are provided with holes 84. The panel is provided with end flanges 86 and 88. These end flanges 86 and 88 are curved for a purpose to be described later.

FIG. 12 illustrates a detail of the joint between adjacent building units in a building according to one aspect of the present invention. The panels 2 illustrated are fragments of a preferred building unit of the shape shown in FIG. 1. These panels 2, as shown in more detail in FIG. 12, each comprise an inner wall 90 spaced from an outer wall 92. Walls 90 and 92 are, in a preferred embodiment, made of glass-or other reinforced-synthetic resin, preferably a polyester or epoxide resin. The space between the walls 90 and 92 is filled with an insulating material 94. A particularly valuable material is foamed polyurethane. Flanges 4 and 6 are attached to each other by a plurality of bolts 96 (one of which is shown in FIG. 12) onto which is threaded a nut 98. The resultant joint between the flanges is sealed on the outside by a strip 100 of a resilient material, for example, polyvinyl chloride, having projections 102 to engage on the sides of the bolt 96 and nut 98 adjacent the panels 2. The sealing strip 100 is inserted after the bullding has been constructed and runs the whole length of the joined flanges 4 and 6. On the interior of the building, the joint between the adjacent units 2 is filled by a finishing strip comprising an insert 104 pinched between and thus connected to the adjacent units 2. A flat face piece 106 is attached to the insert 104. Again the insert 104 and the integral face piece 106 run the full length of the joint between adjacent panels 2. It is inserted before tightening of the bolts 96 and nuts 98 and then pinched in position by tightening the nuts and bolts.

FIG. 13 illustrates a more complicated sealing and finishing strip. In FIG. 13, adjacent panels 2 each abut against a flat sealing member 108 formed at one end with a triangular section head 110 and with limbs 112 at its other end, at the interior of the building. Limbs 112 are formed with projections 113 that engage beneath a triangular head 114 of a sealing strip 116. By this means, a joint between adjacent panels 2 is effectively sealed. If necessary, further sealing can be provided by the provision of outwardly extending flaps on the main body of the flat sealing strip 108. These flaps are not shown in the drawings.

On the exterior surface of the building, the triangular head 110 engages with projections 118 formed on an exterior strip 120. Sealing strip 120 is formed with relatively elongated limb 121 extending outwardly from the projections 118.

FIGS. 14 to 17 demonstrate the steps in providing a simple building according to the present invention. The drawings are diagrammatic as they are intended merely to demonstrate the steps in the construction, not details of the parts used in the construction.

Figure 14:
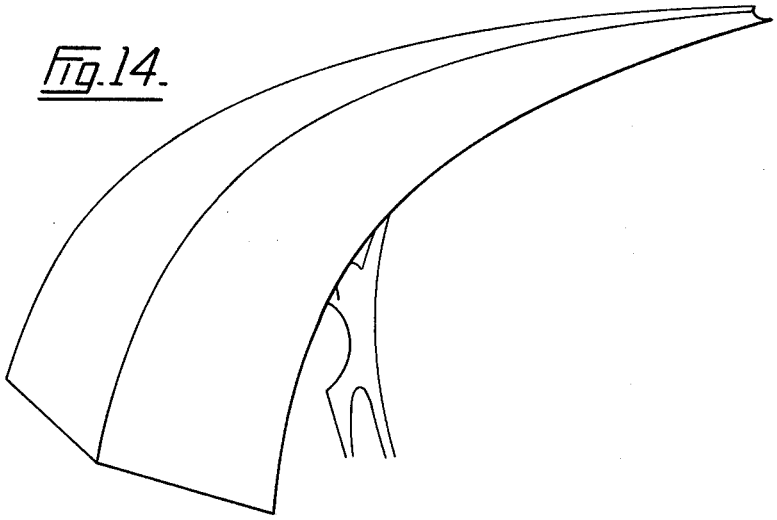
Figure 15:
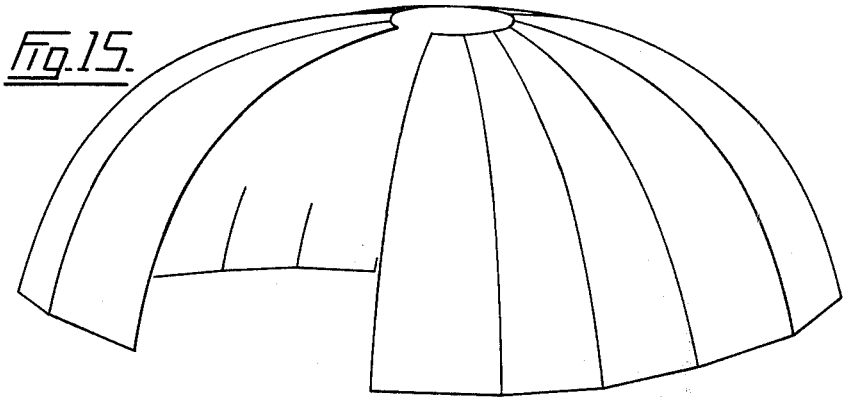
Figure 16:
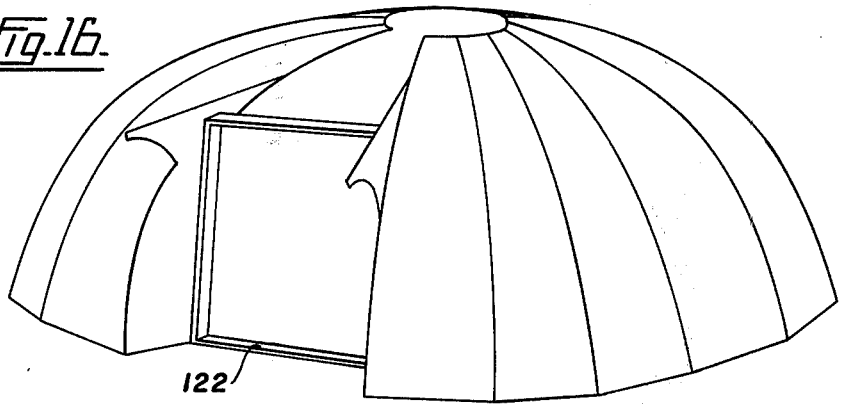

Referring to FIG. 14, a building unit as, for example, in FIG. 1 is raised into a position approximating the position required in the building. A similar panel equipped with a similar flange is placed adjacent the first panel. Bolts are then positioned through the holes 8 in adjoining flanges with which each building unit is provided. Nuts are tightened on the bolts and the two joined panels are then supported while a third, similar panel is attached to one of the outer unattached flanges. When three panels are attached they can be stood up and supported with a prop or a brace. The addition of further panels then continues until the position shown in FIG. 15 is reached. In FIG. 15 the base of the building is short of being a complete polygon by two building units. Two door adaptor pieces 18 are then bolted into position, one against each end building unit—see FIG. 16. Bolts are positioned through the holes 8 in the unattached flanges 4 and 6 and through the holes 22 on the curved edge 20 of the door adaptor piece 18. A door frame 122 is then positioned between the door adaptor pieces 18. A stress beam 30 is positioned on top of the door frame 122 and a roof piece 28 is then positioned over the spaced building units and the upper edges 24 of the door adaptor pieces 18. The roof piece 28 is bolted into position using the holes in the flanges along the sides of the roof piece 28, the holes 8 in the upper part of the building unit 2 and the hole 26 in the upper edge 24 of the door adaptor piece 18.

Referring to FIG. 17, a skylight 124 is then positioned at the top of the building and located in position by the upper flanges 14 of the panels 2 of the building units. Generally a seal of a foamed resin, for example, polyurethane is inserted between the skylights 124 and the upper flange 14. Metal screws may be used to locate the skylights 124 onto the flanges 14.

The building is completed by the positioning of a standard sliding door or similar door assembly within the door frame 122.

Before the bolts are finally tightened a finishing strip insert, such as shown in FIG. 12, is inserted. If the more elaborate finishing strip shown in FIG. 13 is to be used then as the units are put up a sealing member 108 must be positioned between adjoining flanges which may then be firmly bolted together.

A finishing strip—such as shown in FIG. 12—is positioned over the joined flanges.

It is desirable that a base first be provided for the building. Such a base may be a concrete slab, a wood deck or a basement wall. If a base is used the building units are attached to the base by attachment means inserted through holes 12 in the bottom flange 10 of the building unit. These attachment means may be lag bolts or screws or masonry pins may be rammed into a concrete base.

FIG. 17 is an extremely simple building. However, FIGS. 18 and 19 are diagrammatic plans of more complicated buildings possible using the building units according to the present invention. In these Figures, Roman Numerals are used to indicate the building unit by a reference to the drawing in which the building unit is illustrated.

The building whose plan is shown in FIG. 18 comprises a main body made up of building units V. At each end of the main body there are end units made up of building units I each including a door portion indicated by the reference numeral 28 of the roof piece. The roof of the building comprises a building unit IX attached at each end to building units VII to incorporate skylights 126. By the insertion of building units X a wing made up of building units V and I is formed. A roof for this wing of the building is formed by a building panel IX extending from the building panel IX of the main building. Building panel IX of the wing is attached to a building panel VII in order to accommodate skylight 128. The building is constructed in a manner precisely analogous to that described in relation to FIGS. 14 to 17 although with the more complicated plan it is usual to have a base on which to build the building.

FIG. 19 illustrates a further plan for a building according to the invention in this case attached to an existing or conventional structure 130. A doorway in the conventional structure 130 has adaptor pieces 40 according to FIG. 8 attached by flange 49 with the curved edge 42 extending outwardly. The adaptor pieces 40 are not shown in the plan drawing. Building units V are attached to each adaptor piece on each side of the outlet of the structure 130 and the building proceeds as described above until it is required to attach the annexes 132 and 134. The roof of the main building shown in FIG. 19 is formed with a plurality of building units VI to facilitate the use of a large number of skylights 136.

Annex 132 is added by incorporating two adaptor pieces 40 to the main structure. A panel IX is then attached to the top edges 46 of the adaptor pieces 40. Further adaptor pieces 40 are attached to the first two adaptor pieces by abutting and attaching flanges 49. Panels I are then attached to this second pair of adaptor pieces 40. The building of annex 132 then proceeds in the manner described above. The addition of annex 134 is carried out in the same way except that the roof piece in this particular embodiment is a panel XI as annex 134 is attached to the main building at a corner or, more particularly, between two pieces I. Pieces IX and XI may simply be flat and have holes at their periphery. A seal, for example of a silicone resin, can be positioned between the undersides of pieces IX and XI which are then screwed to upper flanges positioned adjacent the top edges of adaptor pieces 40.

Figure 20:
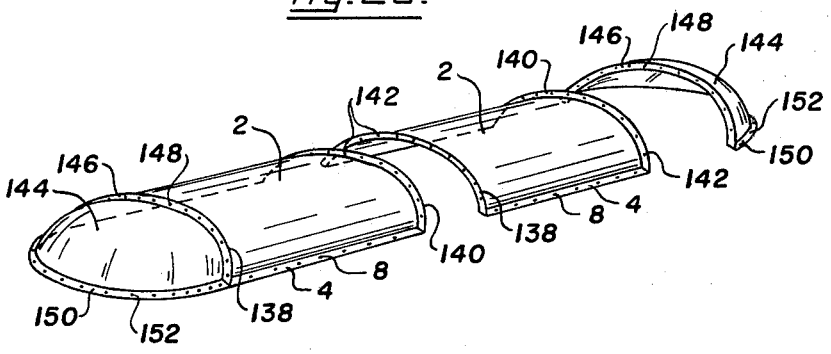
FIG. 20 illustrates a building unit according to the invention used to form a transparent roof.

FIG. 20 illustrates an alternative roof for a building according to the present invention that is made up of transparent building units of the invention. Each unit has a panel 2 of substantially semi-circular shape formed with edge flanges 4 and 6 (not shown in FIG. 20 but same as flange 6 in FIG. 1) and with end flanges 138 and 140. Flanges 4 and 6 are formed with holes 8 and 12 as in FIG. 1. Flanges 138 and 140 have holes 142. The units of FIG. 20 are conveniently formed in four feet long standard sections. The alternative roof is completed by substantially quarter spherical end units 144 provided with flanges 146 to abut flange 138 or 140 and to be attached to the abutted flange. Flange 146 has holes 148 to permit the attachment. The end units 144 are also provided with flange 150 formed with holes 152.

The roof shown in FIG. 20 is attached to a relatively long building, for example, as illustrated in the main building sections in FIGS. 18 and 19. It may replace, wholly or in part, the skylights and units IX and VI shown in FIGS. 18 and 19. It is attached to the wall building units I, V, etc., modified by not having an upper, substantially normal flange but a flange projecting outwardly continuous with panel 2 but formed with attachment means in the form of holes alignable with holes 8 in flanges 4 and 6 and with holes 152 in flanges 150 of the end unit 144 in the roof illustrated in FIG. 20.

When any building according to the present invention is completed, partitions may be inserted in the interior. Prewired panels including outlets may be installed. Plumbing fixtures and the like fittings may be of standard style and design and can be vented when necessary, according to conventional plumbing practice. Fireplaces and chimneys may be installed again in accordance with conventional practice. Windows may be inserted through the use of panels having preformed and presealed windows. Picture windows may also be inserted. A picture window is inserted in a frame similar to, and installed in the same manner as, the door frame 122.

The building units according to the present invention may be of wood, metal and a wide variety of synthetic resins. However, the preferred building units have separated walls of glass-reinforced resin with an interior of a foamed resin. The foamed resin provides sound and heat insulation for the building.

It has been found desirable to bolt the panels together with standard one-fourth by three-fourths or three-fourths by three-eighths bolts depending upon the size of the building and the size of the units used. However, in addition to the use of bolts and nuts, it is possible to use rivets, dowling and metal studs. In the case of metal studs it may be desirable to attach the studs to one flange of the building unit and to provide corresponding holes in the other flange of the building unit. The units are then attached together by engaging the studs in one flange of one unit with the hole of one flange of another unit and bolting the two flanges together. This procedure continues until the building is completed.

The finishing and exterior sealing strips may be extruded from, for example, polyvinyl chloride but any plastic with similar properties will suffice. It should be emphasized that these units do not give any appreciable strength to the building and do not form a part of the load bearing structure.

Because of the curved exteriors building according to the present invention have been found wind-resistant and able to withstand considerable loads of snow. Using polyurethane insulation it has been found that buildings according to the present invention cost approximately one-third less to heat and cool than conventional structures.

We claim:

1. A building formed from a plurality of building units attached to each other, each unit comprising a panel having an inner surface and an outer surface;

a flange extending outwardly from the periphery of the panel, the flange of each unit being able to abut the flanges of an adjacent unit;

holes formed in at last one of any pair of abutting flanges;

threaded members attached to or insertable through the second of said any pair of abutting flanges and insertable through said holes formed in said at least one of any pair of abutting flanges;

a nut threadedly engaged on each threaded member to secure the flanges of said any pair to each other;

an outer, flexible, hollow sealing strip fitting over and seal sealing attached, abutting flanges, said strip having gripping means on its inner surface providing positive location of the strip over a pair of attached, abutting flanges;

a sealing strip located over each joint between attached building units and connected to at the interior of the building.

2. A building as claimed in claim 1 including a door adaptor piece attached to each of two spaced building units and projecting outwardly of the building at their upper edges;

an upright door frame located between the adaptor pieces; and a roof extending over the adaptor pieces and the door frame, located on the spaced building units and on the projecting upper edges of the door adaptor pieces.

3. A building as claimed in claim 1 in which the sealing strip located over each joint between attached building units at the interior of the building comprises a flat facing piece that abuts the inner surfaces of attached units, said strip including a locating insert extending to engage between the units to locate the sealing strip.

4. A building as claimed in claim 1 including a flexible seal located between joined flanges and extending from inside to outside of the building;

a head formed on the flexible seal at the exterior of the building, said head being engaged by inward projections on the inner surface of said outer, flexible, hollow, sealing strip to provide positive location of the strip over a pair of joined flanges;

spaced resilient members on the inner end of the flexible seal, each spaced resilient member being formed with inner shoulders formed adjacent each end;

a head on the inner sealing strip extending from the sealing strip to be gripped between the inner shoulders of the resilient member to locate the inner strip in position at the interior of the building.

5. A building as claimed in claim 1 in which holes are formed in all the flanges and in which bolts, spaced from the outer surface of the building unit, extend through the holes and are engaged by nuts.

6. A building as claimed in claim 5 in which the sealing strip has inward projections which comprise gripping means, said inward projections engaging in the space between the bolts and the building unit to provide a positive location of the strip over a pair of attached, abutting flanges.

* * * * *